US006874462B2

(12) United States Patent
Matthews

(10) Patent No.: US 6,874,462 B2
(45) Date of Patent: Apr. 5, 2005

(54) ADAPTABLE MODIFICATION OF CYLINDER DEACTIVATION THRESHOLD

(75) Inventor: Gregory P. Matthews, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/626,002

(22) Filed: Jul. 24, 2003

(65) Prior Publication Data

US 2005/0016492 A1 Jan. 27, 2005

(51) Int. Cl.[7] ..... F02B 77/00
(52) U.S. Cl. ..... 123/198 F
(58) Field of Search ..... 123/198 F, 481, 123/399; 701/110; 73/116, 118.1

(56) References Cited

U.S. PATENT DOCUMENTS 4,305,355 A * 12/1981 Jordan ..... 123/198 F
6,615,804 B2 * 9/2003 Matthews et al. ..... 123/481
6,687,602 B2 * 2/2004 Ament ..... 701/110

* cited by examiner

*Primary Examiner*—Willis R. Wolfe
*Assistant Examiner*—Hyder Ali
(74) *Attorney, Agent, or Firm*—Christopher DeVries

(57) ABSTRACT

An engine control system in a vehicle including a variable displacement internal combustion engine, a controller for controlling the displacement of the variable displacement internal combustion engine, where the controller adaptively determines a torque threshold used to switch the variable displacement internal combustion engine between a partially displaced operating mode and a fully displaced operating mode.

7 Claims, 3 Drawing Sheets

ADAPTABLE MODIFICATION OF CYLINDER DEACTIVATION THRESHOLD

TECHNICAL FIELD

The present invention relates to the control of internal combustion engines. More specifically, the present invention relates to a method and apparatus to control a variable displacement internal combustion engine.

BACKGROUND OF THE INVENTION

Regulatory conditions in the automotive market have led to an increasing demand to improve fuel economy and reduce emissions in current vehicles. These regulatory conditions must be balanced with the demands of a consumer for high performance and quick response from a vehicle. Variable displacement internal combustion engines (ICEs) provide for improved fuel economy and torque on demand by operating on the principal of cylinder deactivation. During operating conditions that require high output torque, every cylinder of a variable displacement ICE is supplied with fuel and air (also spark, in the case of a gasoline ICE) to provide torque for the ICE. During operating conditions at low speed, low load, and/or other inefficient conditions for a fully displaced ICE, cylinders may be deactivated to improve fuel economy for the variable displacement ICE and vehicle. For example, in the operation of a vehicle equipped with an eight cylinder variable displacement ICE, fuel economy will be improved if the ICE is operated with only four cylinders during low torque operating conditions by reducing throttling losses. Throttling losses, also known as pumping losses, are the extra work that an ICE must perform when the air filling the cylinder is restricted by a throttle plate during partial loads. The ICE must therefore pump air from the relatively low pressure of an intake manifold through the cylinders and out to the atmosphere. The cylinders that are deactivated will not allow air flow through their intake and exhaust valves, reducing pumping losses by allowing the active cylinders to operate at a higher intake manifold pressure.

In past variable displacement ICEs, the switching or cycling between the partial displacement mode and the full displacement mode was problematic. Frequent cycling between the two operating modes negates fuel economy benefits and affects the driveability of a vehicle having a variable displacement ICE. The operator's driving habits will affect the number of times a variable displacement ICE will cycle between the partial and the full displacement operating modes, and the fuel economy benefits of a variable displacement ICE. Frequent cycling will also impact component life in a variable displacement ICE.

SUMMARY OF THE INVENTION

The present invention is a method and apparatus for the control of cylinder deactivation in a variable displacement engine. In the preferred embodiment of the present invention, an eight-cylinder internal combustion engine (ICE) may be operated as a four-cylinder engine by deactivating four cylinders. The cylinder deactivation occurs as a function of the load, as determined from engine vacuum or engine torque, required by the vehicle and driver behavior. According to the present invention, the activation and deactivation thresholds that are dependent on the magnitude and frequency of calculated torque requests are adaptively modified to eliminate busyness or unnecessary switching between an activated and deactivated state for the variable displacement ICE.

DESCRIPTION OF THE PREFERRED EMBODIMENT

Figure 1:
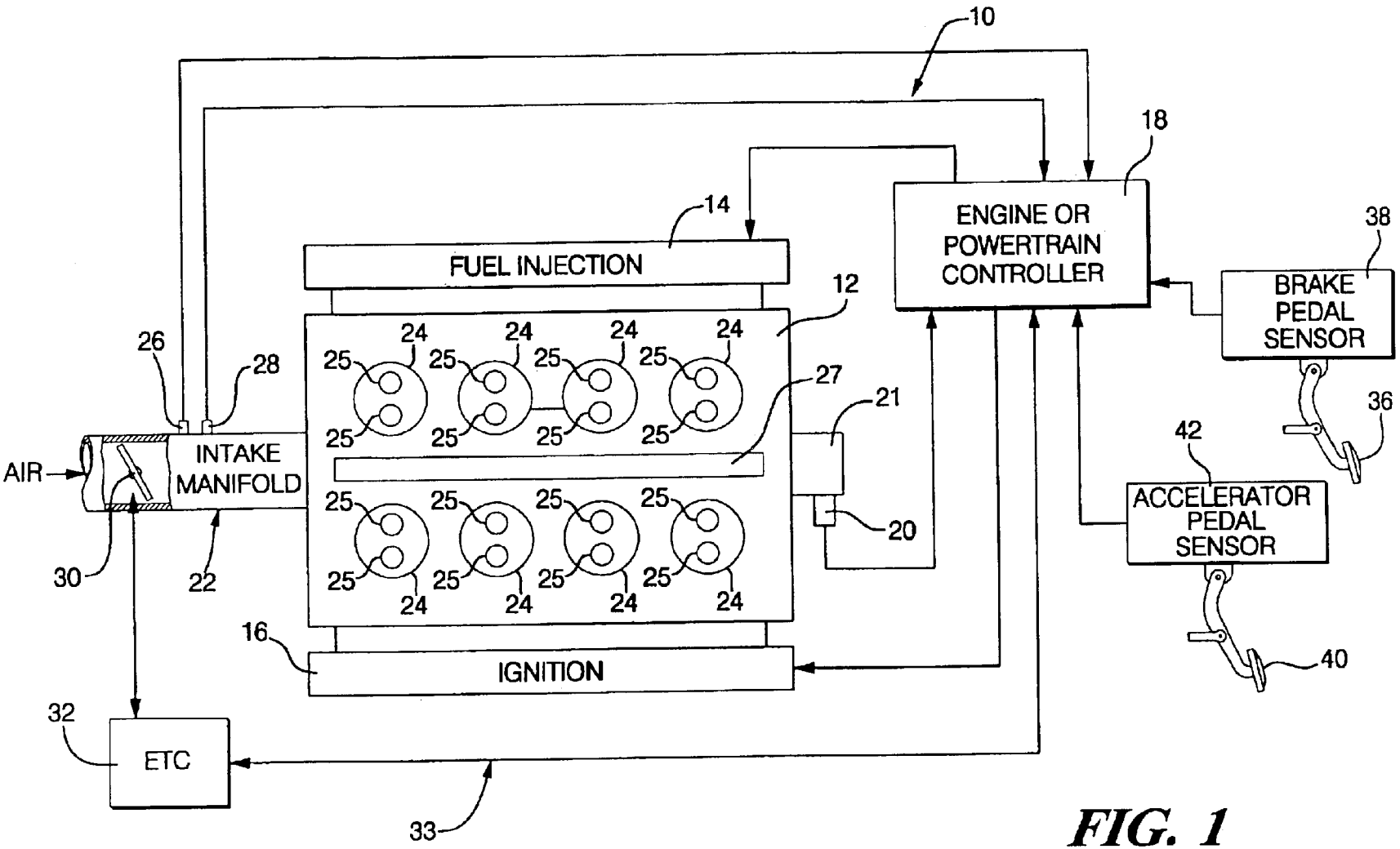
FIG. 1 is a diagrammatic drawing of the control system of the present invention.

FIG. 1 is a diagrammatic drawing of the vehicle control system 10 of the present invention. The control system 10 includes a variable displacement ICE 12 having fuel injectors 14 and spark plugs 16 (in the case of a gasoline engine) controlled by an engine or powertrain controller 18. The ICE 12 crankshaft 21 speed and position are detected by a speed and position detector 20 that generates a signal such as a pulse train to the engine or powertrain controller 18. The ICE 12 may comprise a gasoline ICE, or any other ICE known in the art. An intake manifold 22 provides air to the cylinders 24 of the ICE 10, the cylinders having valves 25. The valves 25 are further coupled to an actuation apparatus 27 such as used in an overhead valve or overhead cam engine configuration that may be physically coupled and decoupled to the valves 25 to shut off air flow through the cylinders 24. An air flow sensor 26 and manifold air pressure (MAP) sensor 28 detect the air flow and air pressure within the intake manifold 22 and generate signals to the powertrain controller 18. The airflow sensor 26 is preferably a hot wire anemometer and the MAP sensor 28 is preferably a strain gauge.

An electronic throttle 30 having a throttle plate controlled by an electronic throttle controller 32 controls the amount of air entering the intake manifold 22. The electronic throttle 30 may utilize any known electric motor or actuation technology in the art including, but not limited to, DC motors, AC motors, permanent magnet brushless motors, and reluctance motors. The electronic throttle controller 32 includes power circuitry to modulate the electronic throttle 30 and circuitry to receive position and speed input from the electronic throttle 30. In the preferred embodiment of the present invention, an absolute rotary encoder is coupled to the electronic throttle 30 to provide speed and position information to the electronic throttle controller 32. In alternate embodiments of the present invention, a potentiometer may be used to provide speed and position information for the electronic throttle 30. The electronic throttle controller 32 further includes communication circuitry such as a serial link or automotive communication network interface to communicate with the powertrain controller 18 over an automotive communications network 33. In alternate embodiments of the present invention, the electronic throttle controller 32 may be fully integrated into the powertrain controller 18 to eliminate the need for a physically separate electronic throttle controller.

A brake pedal 36 in the vehicle is equipped with a brake pedal sensor 38 to determine the braking frequency and/or amount of pressure generated by an operator of the vehicle on the brake pedal 36. The brake pedal sensor 38 generates a signal to the powertrain controller 18 to determine a braking condition for the vehicle. A braking condition will indicate a low torque/low demand condition for the variable displacement ICE 12. An accelerator pedal 40 in the vehicle is equipped with a pedal position sensor 42 to sense the position and rate of change of the accelerator pedal 40. The pedal position sensor 42 signal is also communicated to the powertrain controller 18. In the preferred embodiment of the present invention, the brake pedal sensor 38 is a strain gauge and the pedal position sensor 42 is an absolute rotary encoder.

The present invention addresses the problems of busyness or high frequency switching between a partial displacement and a full displacement of the variable displacement ICE 10. In past variable displacement ICEs, the switching or cycling between the partial displacement mode and the full displacement mode was problematic. Frequent cycling between the two operating modes negates fuel economy benefits and effects the drivability of a vehicle having a variable displacement ICE. Frequent cycling will also impact component life in a variable displacement ICE. The switching thresholds are calibrated on an engine dynamometer, but no two vehicles are the same and the variable displacement ICE 10 will behave differently under different environmental conditions.

Figure 2:
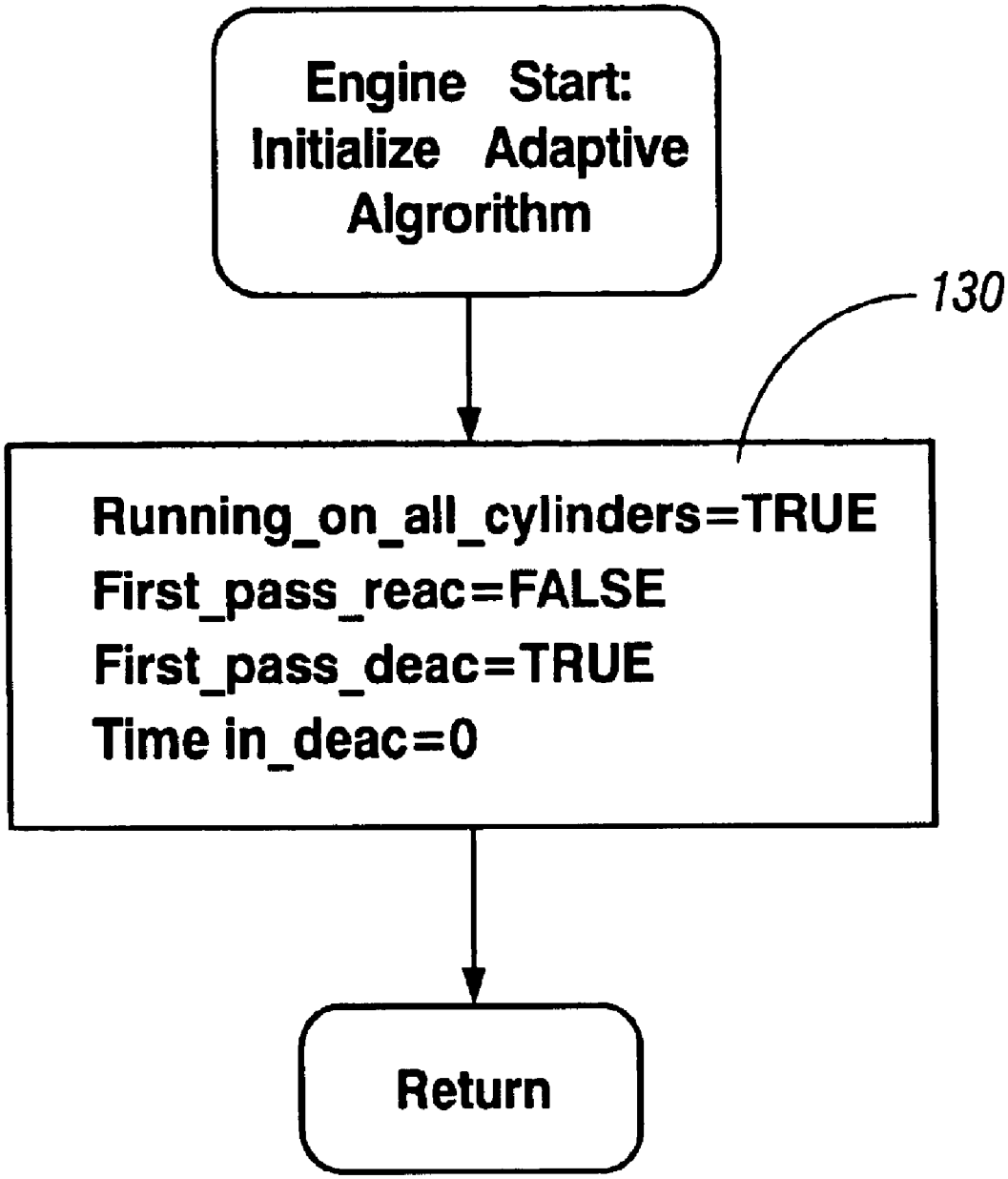
FIG. 2 is a flowchart of a method of the present invention.

Referring to FIG. 2, an initialization method of the present invention is illustrated. Upon engine start, Block 130 is executed, initializing the variables used by the adaptive threshold logic as follows: the variable Running_on_all_cylinders is set to TRUE, the variable First_pass_reac is set to FALSE, the variable First_pass_deac is set to TRUE, and the variable Time_in_deac is set to zero.

Figure 3:
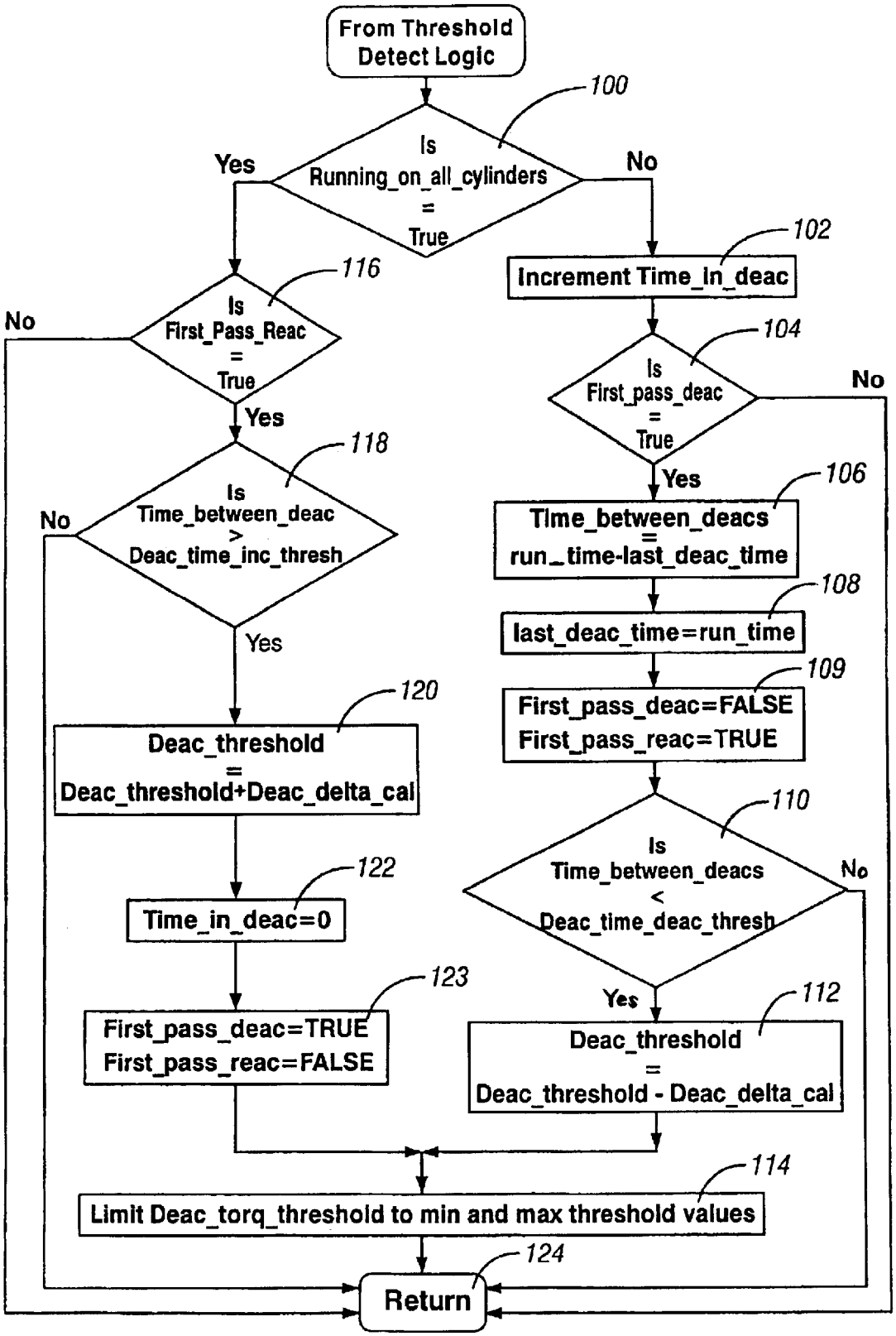
FIG. 3 is a flowchart of the initialization of variables used by the present invention.

Referring to FIG. 3, the adaptive threshold logic of the present invention is executed following the completion of the standard threshold detection logic described in U.S. Ser. No. 10/104,111, which is hereby incorporated by reference in its entirety. The method begins at block 100, which determines whether the system is Running_on_all_cylinders. If block 100 is false, then the ICE 12 is operating in the "deactivated" or partially displaced operating mode and block 102 is executed. If block 100 is true, then the ICE 12 is operating in the "reactivated" or fully displaced operating mode and block 116 is executed. At block 102, the variable Time_in_deac, representing the time spent in a deactivated mode, is incremented by the sampling rate of the present method (Ts) in the controller 18. Following block 102, block 104 is executed to determine whether this is the first pass/execution of the method since the ICE 12 entered a deactivated mode. If block 104 is false, block 124 is executed and the method is exited; otherwise, if block 104 is true, block 106 is executed. At block 106, the variable Time_between_deacs, representing the time between deactivations, is calculated as the difference between the current time as read from a hardware timer/clock in the ECU, and the time of the last deactivation. Following block 106, block 108 is executed and the variable last deac_time, representing the last deactivation time, is set to the run_time from the controller 18 hardware. Following block 108, block 109 is executed, block 109 sets the flags First_pass_reac to TRUE and First_pass_deac to FALSE so as to be able to detect the first pass or execution of the method after the ICE 12 enters the reactivated mode. Following block 109, block 110 is executed to determine if the Time_between_deacs is less than a calibrated threshold, Deac_time_deac_thresh. If block 110 is false, block 124 is executed and the method is exited; otherwise, block 112 is executed. In block 112 the variable Deactivation_threshold, representing the torque value or vacuum level at which the standard threshold detection logic switches from fully displaced mode to partially displaced mode, is decremented by the precalibrated amount Deactivation_delta_cal.

The calibration variable, Deactivation_delta_cal, is set as a compromise. If set relatively large, the system will not readily enter a deactivated mode the next time the logic checks to see if ICE 12 should be in a deactivated mode. If set relatively small, the standard detection logic will once again set ICE 12 in a deactivated mode for too short of a time. The result is a rapid switching from a fully displaced operating mode to a partially displaced or deactivated operating mode. Should this occur, the method of FIG. 4 would once again decrease the threshold and make it even more difficult to enter a deactivated mode. This would continue until the ICE 12 no longer switched rapidly between fully displaced and partially displaced operating modes. Following block 112, block 114 is executed, restricting the final threshold to be between some calibrated minimum and maximum values. After block 114 is executed, block 124 is executed and the method is exited.

Returning to the start of the method of FIG. 3, if block 100 is true, then the ICE 12 is in a reactivated mode and block 116 is executed. Block 116 determines if this is the first pass or execution of the present method since the ICE 12 entered a reactivated mode. If false, block 124 is executed and the method is exited. Block 116 determines if the flag First_pass_reac is true, indicating that this is the first time the ICE 12 has been reactivated to operate in a fully displaced mode. If block 116 is true, then block 118 is executed. Block 118 determines if the output of block 102 (Time_in_deac) is greater than a calibrated variable, Deac_time_inc_thresh. If block 118 is false, block 124 is executed and the method is exited; otherwise, if block 118 is true, block 120 is executed. At block 120, the variable Deac_threshold is incremented by the calibration variable Reactivation_delta_cal. This calibration value is set to be a relatively small fraction of the calibration variable Deactivation_delta_cal_used in block 112.

The purpose of block 120 is to make it less difficult to enter the deactivated mode after each time that a deactivated mode was successfully maintained for a long period of time. The Reactivation_delta_cal in block 118 inhibits block 112 from making it difficult to enter a deactivated mode by providing a mechanism, such that if a deactivated mode is entered for a suitably long time, it is slightly easier to enter the deactivated mode. Blocks 112 and 120 counterbalance each other so that the minimum or maximum threshold limits of block 114 would only be achieved under extremely rare conditions. After block 120, block 122 is executed, block 123 sets the flags First_pass_reac to false and First_pass_deac to true, so as to be able to detect the first pass or execution of the method after the ICE 12 enters the deactivated mode. Following block 120, block 122 is executed. At block 122 the variable Time_in_deac is reset to zero, in preparation for the next deactivated event. Following block 122, block 114 is executed restricting the final threshold value, Deac_torq_threshold, to be between some calibrated minimum and maximum values. After block 114 is executed, block 124 is executed and the method is exited.

While this invention has been described in terms of some specific embodiments, it will be appreciated that other forms can readily be adapted by one skilled in the art. Accordingly, the scope of this invention is to be considered limited only by the following claims.

What is claimed is:

1. An engine control system in a vehicle comprising:

a variable displacement internal combustion engine;

a controller for controlling the displacement of said variable displacement internal combustion engine;

wherein said controller adaptively determines a torque threshold used to switch the variable displacement internal combustion engine between a partially displaced operating mode and a fully displaced operating mode based on a time the variable displacement internal combustion engine operates in said partially displaced operating mode.

2. The engine control system of claim 1 wherein said variable displacement internal combustion engine is a gasoline engine.

3. The engine control system of claim 1 wherein said variable displacement internal combustion engine includes at least six cylinders.

4. The engine control system of claim 1 wherein said variable displacement internal combustion engine is an eight-cylinder engine.

5. The engine control system of claim 1 further comprising a brake pedal sensor electronically coupled to said controller.

6. A method of controlling the displacement of a variable displacement internal combustion engine comprising the steps of:

measuring a variable indicative of torque for the variable displacement internal combustion engine;

determining a time the variable displacement engine operates in a partially displaced operating mode; and adaptively modifying a torque threshold to vary the displacement of the variable displacement internal combustion engine based on said time.

7. A method of controlling the displacement of a variable displacement internal combustion engine comprising the steps of:

measuring a engine intake manifold vacuum for the variable displacement internal combustion engine; and adaptively modifying a vacuum threshold to vary the displacement of the variable displacement internal combustion engine based on a time the variable displacement engine operated in a partially displaced operating mode.

* * * * *